US010569947B2

(12) United States Patent
Ball et al.

(10) Patent No.: US 10,569,947 B2
(45) Date of Patent: Feb. 25, 2020

(54) CARTON AND CARTON BLANK AND A HANDLE STRUCTURE THEREFOR

(71) Applicant: WestRock Packaging Systems, LLC, Atlanta, GA (US)

(72) Inventors: Nathaniel B. Ball, Richmond, VA (US); John W. Cash, III, Dallas, GA (US)

(73) Assignee: WestRock Packaging Svstems, LLC, Atlanta, GA (US)

( * ) Notice: Subject to any disclaimer, the term of this patent is extended or adjusted under 35 U.S.C. 154(b) by 0 days.

(21) Appl. No.: 16/244,417

(22) Filed: Jan. 10, 2019

(65) Prior Publication Data

US 2019/0144182 A1 May 16, 2019

Related U.S. Application Data

(63) Continuation of application No. 15/517,450, filed as application No. PCT/US2015/053753 on Oct. 2, 2015, now Pat. No. 10,214,333.

(60) Provisional application No. 62/060,053, filed on Oct. 6, 2014.

(51) Int. Cl.

| | |
|---|---|
| ***B65D 71/12*** | (2006.01) |
| ***B65D 71/36*** | (2006.01) |
| ***B65D 5/46*** | (2006.01) |
| ***B65D 75/06*** | (2006.01) |

(52) U.S. Cl.

CPC ..... *B65D 71/12* (2013.01); *B65D 5/46* (2013.01); *B65D 71/36* (2013.01); *B65D 75/06* (2013.01); *B65D 2571/0058* (2013.01); *B65D 2571/0066* (2013.01); *B65D 2571/00141* (2013.01); *B65D 2571/00469* (2013.01); *B65D 2571/00524* (2013.01); *B65D 2571/00543* (2013.01); *B65D 2571/00728* (2013.01)

(58) Field of Classification Search

CPC ..... B65D 71/12; B65D 71/36; B65D 75/06; B65D 5/46; B65D 2571/00141; B65D 2571/00469; B65D 2571/00524; B65D 2571/00543; B65D 2571/0058; B65D 2571/0066; B65D 2571/00728

See application file for complete search history.

(56) References Cited

U.S. PATENT DOCUMENTS

| | | | |
|---|---|---|---|
| 5,639,017 | A | 6/1997 | Fogle |
| 5,826,783 | A | 10/1998 | Stout |
| 6,131,803 | A | 10/2000 | Oliff |
| 6,394,742 | B1 | 5/2002 | Buscema |
| 2005/0167476 | A1 | 8/2005 | Ikeda |
| 2005/0178791 | A1 | 8/2005 | Miller |
| 2005/0247767 | A1 | 11/2005 | Smalley |
| 2007/0199979 | A1 | 8/2007 | Holley |

(Continued)

FOREIGN PATENT DOCUMENTS

| | | | |
|---|---|---|---|
| EP | 1334033 | A2 | 8/2003 |
| EP | 2669205 | A1 | 12/2013 |

*Primary Examiner* — Corey N Skurdal

(74) *Attorney, Agent, or Firm* — WestRock Intellectual Property Group

(57) ABSTRACT

A carton includes a first panel and a second panel in overlying relationship with each other so as to form a composite wall and a handle structure formed in the composite wall. The handle structure includes a first end portion formed from the first panel, a grip portion extending from the first end portion into an access opening in the composite wall and a second end portion disposed under the first panel and coupled to the grip portion.

16 Claims, 8 Drawing Sheets

(56) References Cited

U.S. PATENT DOCUMENTS

| | | | |
|---|---|---|---|
| 2008/0067223 | A1 | 3/2008 | Jego |
| 2012/0018502 | A1 | 1/2012 | Walling |
| 2012/0321754 | A1 | 12/2012 | Block |
| 2016/0101918 | A1 | 4/2016 | Bates |
| 2016/0107788 | A1 | 4/2016 | Hayter |
| 2016/0229611 | A1 | 8/2016 | Walling |
| 2017/0137165 | A1 | 5/2017 | Holly, Jr. |

CARTON AND CARTON BLANK AND A HANDLE STRUCTURE THEREFOR

PRIORITY

This application is a continuation of U.S. patent application Ser. No. 15/517,450 filed Apr. 6, 2017 which is a 371 application of International Patent Application No. PCT/US2015/053753 filed Oct. 2, 2015 which claims the priority of U.S. Provisional Patent Application No. 62/060,053 filed Oct. 6, 2014, all of which are incorporated herein by reference in their entirety.

TECHNICAL FIELD

The present disclosure relates to a carton and to a blank for forming the carton more specifically, but not exclusively, to a carton having a handle structure for facilitating the carrying of a package formed from the carton and one or more articles contained within the carton.

BACKGROUND

In the field of packaging it is often required to provide consumers with a package comprising a plurality of primary product containers such as cans, bottles and the like, grouped together in a carton. Such packages are desirable for shipping and distribution, for customer use, and for the display of promotional information. For cost and environmental considerations, the cartons or carriers used in such packages need to be formed from as little material as possible and cause as little wastage in the materials from which they are formed as possible. Another consideration is the strength of the package and its suitability for holding and transporting large weights of articles.

It is desirable to provide a carton having a handle structure for forming a carrying handle such that a user may deploy the handle structure to carry the package. It is desirable that the carrying handle is strong and durable so as to withstand the load of the carton and its contents when the handle is in use. It is also desirable for the carrying handle to be readily deployable by a user. It is also desirable for the carrying handle to be comfortable to use.

SUMMARY

The various embodiments of the present disclosure seek to overcome or at least mitigate against the shortcomings of the prior art and/or provide an improvement in the field of packaging.

According to a first aspect of the disclosure for which protection is sought, there is provided a carton for packaging one or more articles. The carton may comprise a first panel and a second panel in overlying relationship with each other so as to form a composite wall and a handle structure formed in the composite wall. The handle structure may comprises a first end portion formed from the first panel, a grip portion extending from the first end portion into an access opening in the composite wall and a second end portion formed from the second panel, disposed beneath the first panel and coupled to the grip portion.

Optionally, the first end portion is displaceable out of the plane of the first panel.

In some embodiments, the carton comprises a first relief cut which extends from a first side of the grip portion and which defines in part the first end portion of the handle structure.

In some embodiments, the carton comprises a second relief cut which extends from a second, opposing, side of the grip portion and which defines in part the first end portion of the handle structure.

The carton may comprise opposing side walls on opposing side edges of the composite wall and optionally, the first relief cut and the second relief cut extend into a respective one of the opposing side walls.

The carton may comprise a plurality of articles disposed therein and the first and second relief cuts may be disposed adjacent to a void between a pair of two adjacent articles in the carton.

The grip portion may be defined at least in part in the first panel and wherein the grip portion includes a first end and a second end.

The first end of the grip portion may be severably coupled to the first panel and optionally, the second end of the grip portion may be integrally formed with the first top panel.

Optionally, a handle strap is struck from the second panel.

In some embodiments, a first part of the handle strap is disposed below the first panel forming the second end portion of the handle structure and wherein a second part of the handle strap is secured to the second panel.

The first part of the handle strap may be moveable with respect to the second panel.

The first part of the handle strap may be slideable with respect to the second panel.

The first part of the handle strap may be moveable through the access opening.

According to a second aspect of the disclosure for which protection is sought, there is provided a carton for packaging one or more articles. The carton may comprise a first panel and a second panel, the first panel overlying the second panel so as to form a composite wall and a handle structure formed in the composite wall. The handle structure may comprise an access opening in the first panel and a handle strap struck from the second panel. The handle strap may be defined in part by a stepped edge.

In some embodiments, the carton comprises opposing side walls on opposing edges of the composite wall and wherein the stepped edge of the handle strap comprises a plurality of steps and wherein the steps of the stepped edge step incrementally closer to an adjacent one of the opposing side walls as the stepped edge approaches the access opening.

Optionally, the handle strap is arranged such that it widens approaching the access opening.

The stepped edge of the handle strap may be formed from a severance line comprising a plurality of linear sections, each linear section being transversely offset with respect to its adjacent neighbouring linear section.

Optionally, the stepped edge is further defined by a plurality of connection portions, each connection portion being disposed between a pair of adjacent linear sections and wherein each connection portion is transversely offset with respect to the other connection portions.

According to a third aspect of the disclosure for which protection is sought, there is provided a carton for packaging one or more articles. The carton may comprise a top panel having a first side edge and a second side edge, a base panel, a first side panel having a first end edge and being disposed along the first side edge of the top panel. The carton may also comprise a first side end closure panel hinged to the first end edge of the first side panel by a first hinged connection, the first hinged connection defining a hinged edge of the first side end closure panel. A first cutaway may separate a portion of the top panel from an adjacent portion of the first side panel. The first side end closure panel may comprise an end edge opposing the first hinged connection. The end edge may be arranged convergently with the hinged edge in a flat blank and may be configured to be substantially perpendicular to the base panel in the assembled carton.

Optionally, the first side end closure panel comprises a side edge adjacent to the first hinged connection, the side edge being arranged convergently with the hinged edge in a flat blank and configured to be substantially parallel to the base panel in the assembled carton.

Optionally, a non-zero, non-perpendicular angle such as an acute or obtuse angle is defined between the side edge and the first hinged connection when the first side end closure panel is in an unfolded condition with respect to the first side panel.

In some embodiments, the carton comprises a second side panel having a first end edge and being disposed along the second side edge of the top panel. The carton may comprise a second side end closure panel hinged to the first end edge of the second side panel by a second hinged connection, the second hinged connection defining a hinged edge of the second side end closure panel. A second cutaway may separate a portion of the top panel from an adjacent portion of the second side panel. The second side end closure panel may comprise an end edge opposing the second hinged connection. The end edge may be arranged convergently with the hinged edge in a flat blank form and may be configured to be substantially perpendicular to the base panel in the assembled carton.

Optionally, the first side end closure panel and the second side end closure panel are arranged in a partially overlapping relationship to define a seam, wherein the seam is substantially configured to be substantially upright.

Optionally, the first side panel and the second side panel converge towards each other.

In some embodiments, the second side end closure panel comprises a side edge adjacent to the hinged connection; the side edge may be arranged convergently with the hinged edge in a flat blank and may be configured to be substantially parallel to the base panel in the assembled carton.

Optionally, a non-zero, non-perpendicular angle such as an acute or obtuse angle is defined between the side edge and the second hinged connection when the second side end closure panel is in an unfolded condition with respect to the second side panel.

The side edge of the first side end closure panel and the side edge of the second side end closure panel may be substantially collinear.

According to a fourth aspect of the disclosure for which protection is sought, there is provided a blank for forming a carton. The blank may comprise a first panel and a second panel configured to be disposed in overlying relationship with each other for forming a composite wall and a handle structure. The handle structure may be formed in part in the first panel and in part in the second panel. The handle structure may comprise a first end portion formed from the first panel, an access opening defined at least in part in the first panel, a grip portion extending from the first end portion into the access opening and a second end portion formed from the second panel. The second end portion may be configured to be disposed under the first panel and coupled to the grip portion when the handle structure is assembled.

According to a fifth aspect of the disclosure for which protection is sought, there is provided a blank for forming a carton. The blank may comprise a first panel and a second panel. The first panel and the second panel may be configured to be disposed overlying relationship with each other for forming a composite wall. The blank may comprise a handle structure comprising a handle strap struck from the first panel. The handle strap may be defined in part by a stepped edge.

According to a sixth aspect of the disclosure for which protection is sought, there is provided a blank for forming a carton. The blank may comprise a top panel having a first side edge and a second side edge, a base panel, a first side panel having a first end edge and is disposed along the first side edge of the top panel. The blank may comprise a first side end closure panel hinged to the first end edge of the first side panel by a first hinged connection. The first hinged connection may define a hinged edge of the first side end closure panel. A first cutaway may separate a portion of the top panel from an adjacent portion of the first side panel. The first side end closure panel may comprise an end edge opposing the first hinged connection. The end edge may be arranged convergently with the hinged edge and may be configured to be substantially perpendicular to the base panel in an assembled carton.

Optionally, the first side end closure panel comprises a side edge adjacent to the first hinged connection, the side edge being arranged convergently with the hinged edge in a flat blank and configured to be substantially parallel to the base panel in the assembled carton.

A non-zero, non-perpendicular angle such as an acute or obtuse angle may be defined between the side edge and the hinged connection when the first side end closure panel is in an unfolded condition.

In some embodiments, the blank according comprises a second side panel having a first end edge and being disposed along the second side edge of the top panel. A second side end closure panel may be hinged to the first end edge of the second side panel by a second hinged connection. The second hinged connection may define a hinged edge of the second side end closure panel. A second cutaway may separate a portion of the top panel from an adjacent portion of the second side panel. The second side end closure panel may comprise an end edge opposing the second hinged connection. The end edge may be arranged convergently with the hinged edge and may be configured to be substantially perpendicular to the base panel in an assembled carton.

According to a seventh aspect of the disclosure for which protection is sought, there is provided a carton for packaging one or more articles comprising:

a top panel having a first side edge and a second side edge;

a base panel;

a first side panel having a first end edge and being disposed along the first side edge of the top panel, the first side panel being longer in length than the top panel; and a first side end closure panel hinged to the first end edge of the first side panel by a first hinged connection, the first hinged connection defining a hinged edge of the first side end closure panel;

wherein the first side end closure panel comprises an end edge opposing the first hinged connection, the end edge being arranged convergently with the hinged edge in a flat blank and configured to be substantially perpendicular to the base panel in the assembled carton.

Optionally, the first side end closure panel comprises a side edge adjacent to the first hinged connection, the side edge being arranged convergently with the hinged edge in a flat blank and configured to be substantially parallel to the base panel in the assembled carton. Optionally, a non-zero, non-perpendicular angle is defined between the side edge and the first hinged connection when the first side end closure panel is in an unfolded condition.

According to an eighth aspect of the disclosure for which protection is sought, there is provided a blank for forming a carton, the blank comprising:

a top panel having a first side edge and a second side edge;

a base panel;

a first side panel having a first end edge and being disposed along the first side edge of the top panel, the first side panel being longer in length than the top panel; and a first side end closure panel hinged to the first end edge of the first side panel by a first hinged connection, the first hinged connection defining a hinged edge of the first side end closure panel;

wherein the first side end closure panel comprises an end edge opposing the first hinged connection, the end edge being arranged convergently with the hinged edge and configured to be substantially perpendicular to the base panel in an assembled carton.

Optionally, the first side end closure panel comprises a side edge adjacent to the first hinged connection, the side edge being arranged convergently with the hinged edge in a flat blank and configured to be substantially parallel to the base panel in the assembled carton.

Optionally, a non-zero, non-perpendicular angle is defined between the side edge and the hinged connection when the first side end closure panel is in an unfolded condition.

Within the scope of this application it is intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Various embodiments of the disclosure will now be described with reference to the accompanying drawings, in which.

DETAILED DESCRIPTION OF EMBODIMENTS

Detailed descriptions of specific embodiments of the packages, blanks, cartons and handle structures therefor are disclosed herein. It will be understood that the disclosed embodiments are merely examples of the way in which certain aspects of the disclosure can be implemented and do not represent an exhaustive list of all of the ways the disclosure may be embodied. As used herein, the word "exemplary" is used expansively to refer to embodiments that serve as illustrations, specimens, models, or patterns. Indeed, it will be understood that the packages, blanks, cartons and handle structures therefor described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the disclosure.

Figure 1:
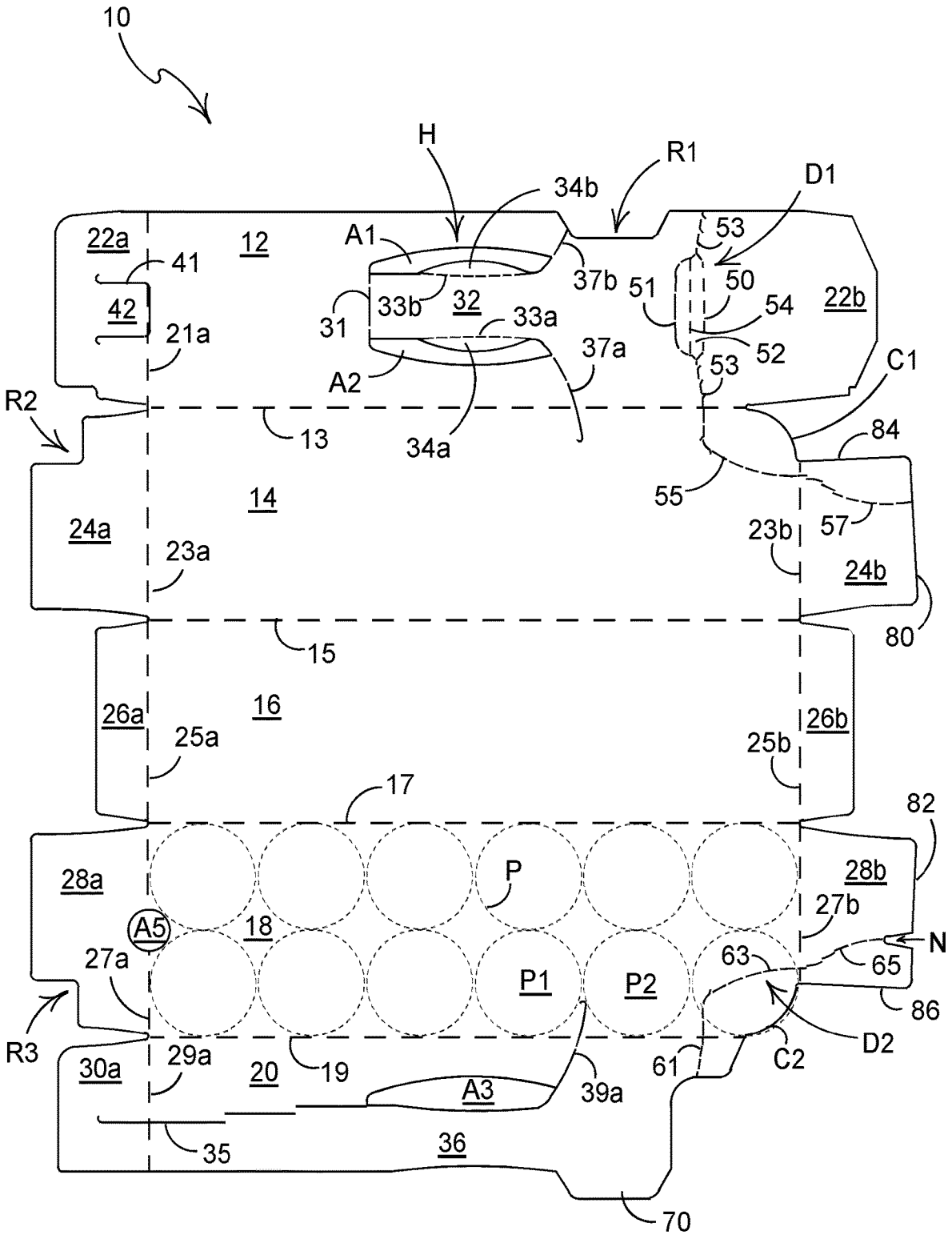
FIG. 1 is a plan view from above of a blank for forming a carton according to an embodiment of the present disclosure.
Figure 2:
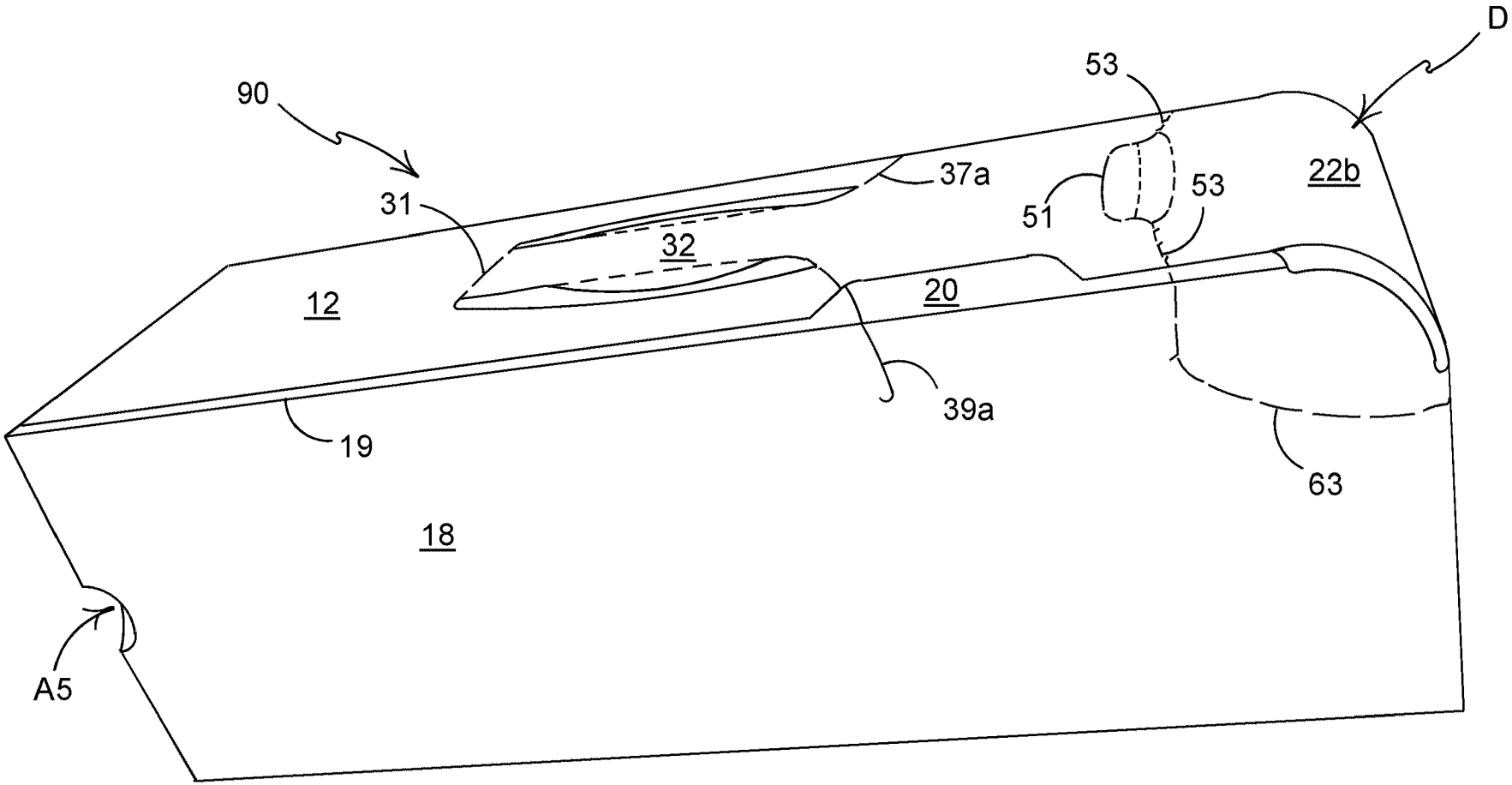
FIG. 2 is a perspective view from above of a carton formed from the blank of FIG. 1.

FIG. 1 shows a plan view of a blank 10 capable of forming a carton 90, as shown in FIG. 2. The carton 90 is used for containing a group (one or more) of primary product containers such as, but not limited to, cans, pouches, brick packs and bottles, hereinafter referred to as articles B.

In the embodiments detailed herein, the terms "carton" and "carrier" refer, for the non-limiting purpose of illustrating the various features of the invention, to a container for engaging, carrying, and/or dispensing articles, such as product containers. It is contemplated that the teachings of the disclosure can be applied to various primary product containers, which may or may not be tapered and/or cylindrical. Suitable containers include bottles (for example metallic, glass or plastics bottles), cans (for example aluminium cans), sprayers or fluid dispensers such as a perfume bottles, tins, pouches, packets, and the like. It will be appreciated that the carton 90 may be employed, in some applications, to package primary products such as an alcoholic or non-alcoholic beverage held within primary product containers. In other embodiments the primary products are for example, but without limitation, electrical goods or other items that may be packaged directly within the carton 90.

The blanks 10, 110 shown and described herein are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carton 90 described in more detail below.

In various embodiments, the blanks 10, 110 are configured to form a carton 90 or carrier 90 for packaging an illustrative arrangement of optional articles. In the illustrated embodiments the arrangement is a 2×6 matrix or array of twelve articles B. In other embodiments other arrangements may be employed. The blank can be alternatively configured to form a carton for packaging other types, number and size of article and/or for packaging articles in a different arrangement or configuration.

Referring again to FIG. 1, the blank 10 comprises a plurality of main panels 12, 14, 16, 18, 20 hinged together in a linear series. More specifically, the blank 10 comprises a first top panel 12 hinged to a first side panel 14 by a hinged connection 13 such as a fold line. The first top panel 12 forms a part of a composite top wall of the carton 90, and the first side panel 14 forms a first side wall of the carton 90. The first side panel 14 is hinged to a base panel 16 by a hinged connection such as a fold line 15. The base panel 16 forms a base wall of the carton 90. The base panel 16 is hinged to a second side panel 18 by a hinged connection such as a fold line 17. The second side panel 18 forms a second side wall of the carton 90. The second side panel 18 is hinged to a second top panel 20 by a hinged connection such as a fold line 19. The second top panel 20 forms a further part of the composite top wall of the carton 90. As such, the composite top wall of the carton 90 is formed from the first top panel 12 and the second top panel 20.

The plurality of main panels 12, 14, 16, 18, 20 forms an open ended tubular structure (not shown) when in a partially set up condition. Each of the ends of the tubular structure is at least partially closed by end closure panels 22*a*, 24*a*, 26*a*, 28*a*, 30*a*; 22*b*, 24*b*, 26*b*, 28*b*. End closure panels 22*a*, 24*a*, 26*a*, 28*a*, 30*a* are configured to close a first end of the tubular structure, and end panels 22*b*, 24*b*, 26*b*, 28*b* are configured to close a second end of the tubular structure.

A first end closure panel 22*a* is hinged to a first end of first top panel 12 by a hinged connection such as a fold line 21*a*. A second end closure panel 24*a* is hinged to a first end of first side panel 14 by a hinged connection such as a fold line 23*a*. A third end closure panel 26*a* is hinged to a first end of base panel 16 by a hinged connection such as a fold line 25*a*. A fourth end closure panel 28*a* is hinged to a first end of the second side panel 18 by a hinged connection such as a fold line 27*a*. A fifth end closure panel 30*a* is hinged to a first end of the second top panel 20 by a hinged connection such as a fold line 29*a*.

A sixth end closure panel 22B is coupled to a second end of first top panel 12. The sixth end closure panel 22B provides a transition from an end wall of a setup carton 90 into the composite top wall 12/20. The sixth end closure panel 22B can be considered to be an extension of the top panel 12 or integrally formed with the top panel 12 since there is no localized fold line or hinged connection which defines an edge of the top panel 12 or edge of sixth end closure panel 22*b*. At least a portion of the sixth end closure panel 22B as shown in FIG. 2 can be considered to form a part of the top wall of the carton 90. A seventh end closure panel 24*b* is hinged to a second end of the first side panel 14 by a hinged connection 23*b* such as a fold line. An eighth end closure panel 26*b* is hinged to a second end of base panel 16 by a hinged connection such as a fold line 25*b*. A ninth end closure panel 28*b* is hinged to a second end of second side panel 18 by a hinged connection such as a fold line 27*b*.

In some embodiments the sixth end closure panel 22*b* may comprise one or more fold lines for facilitating folding or bending of the sixth end closure panel 22*b* about a portion of an article disposed in the carton adjacent thereto.

The first end closure panel 22*a* together with the fifth end closure panel 30*a* forms a composite upper end closure panel at a first end of the tubular structure. The sixth end closure panel 22*b* forms an upper end closure panel at a second end of the tubular structure. The third end closure panel 26*a* and the eighth end closure panel 26*b* each form a lower end closure panel at opposing ends of the tubular structure.

The second end closure panel 24*a* and the fourth end closure panel 28*a* each form a major side end closure panel at the first end of the tubular structure. The seventh end closure panel 24*b* and the ninth end closure panel 28*b* each form a major side end closure panel at the second end of the tubular structure.

Optionally, the blank 10 comprises an access device or dispenser D (see FIG. 2). The access device D comprises a plurality of weakened lines of severance 51, 53, 55, 57, 61, 63, 65. Weakened line of severance 53 serves to hingedly connect the sixth end closure panel 22*b* to the second end of first top panel 12. The access device D is defined by a first portion D1 and a second portion D2, as shown in FIG. 1.

The first portion D1 comprises a first weakened line of severance 57 that commences from a side edge of the seventh end closure panel 24*b* (see FIG. 1). The first weakened line of severance 57 extends across the seventh end closure panel 24*b*. The first weakened line of severance 57 is continuous with a second weakened line of severance 55 provided in the first side panel 14. The second weakened line of severance 55 extends from an end edge of the first side panel 14 (defined by hinged connection 23*b* between the first side panel 14 and the seventh end closure panel 24*b*) to an adjacent side edge of the first side panel 14 (defined by fold line 13, between the first side panel 14 and the first top panel 12).

A third weakened line of severance 53 is provided in the first top panel 12 and is continuous with the second weakened line of severance 55. The third weakened line of severance 53 extends across the first top panel 12.

The third weakened line of severance 53 is interrupted by a tear initiation device comprising a tab 52 struck from the first top panel 12 and hinged thereto by a hinged connection such as a fold line 50. The tab 52 is defined in part by a fourth weakened line of severance 51. The fourth weakened line of severance 51 is substantially "U" shaped and forms a continuous line of severance with the third weakened line of severance 53 extending across the first top panel 12.

Optionally, the tab 52 comprises a hinged connection such as a fold line 54 extending transversely thereacross.

The second portion D2 of the optional access device D comprises a fifth weakened line of severance 65 that commences from a slot or notch N provided in a side edge of the ninth end closure panel 28*b*. The notch N extends from a side edge of the ninth end closure panel 28*b* and partially thereinto. The notch N is dimensioned to be substantially equal in length to the lateral distance of overlap between the seventh and ninth end closure panels 24*b*, 28*b* when the blank 10 is assembled into the carton 90. The fifth weakened line of severance 65 extends across the ninth end closure panel 28*b*. The fifth weakened line of severance 65 is continuous with a sixth weakened line of severance 63 provided in the second side panel 18. The sixth weakened line of severance 63 extends from an end edge of the second side panel 18 (defined by fold line 27*b* between the second side panel 18 and the ninth end closure panel 28*b*) to an adjacent side edge of the second side panel 18 (defined by fold line 19 between the second side panel 18 and the second top panel 20).

A seventh weakened line of severance 61 is provided in the second top panel 20 and is continuous with the sixth weakened line of severance 63. The seventh weakened line of severance 61 extends across a portion of the second top panel 20.

In a setup carton 90 (see FIG. 2) the first portion D1 and the second portion D2 of the access device D are arranged to form a continuous loop such that a corner portion of the carton 90 is at least partially severable or removable from the carton 90. The seventh weakened line of severance 61 is disposed in vertical registry with an overlying portion of the third weakened line of severance 53. The provision of an access device or dispenser is optional and in other embodiments is omitted. In embodiments incorporating an access device or dispenser the size, form, position and any other aspects of its configuration may differ from the access device described and illustrated herein.

Optionally, the blank 10 comprises an aperture A5 struck in part from the second side panel 18 and in part from the fourth end closure panel 28*a*. In an assembled or erected carton 90 the aperture A5 provides a handling device, suitable for facilitating removal of the carton 90 from a shelf or stack of tightly packed similar cartons 90.

Optionally, a cutaway is provided at an upper corner C1 of the first side panel 14. In the illustrated embodiment, the cutaway is shaped so that the upper corner C1 of the first side panel 14 is curved or rounded at the second end thereof. Optionally, a cutaway is provided at an upper corner C2 of the second side panel 18. In the illustrated embodiment the cutaway is shaped so that the upper corner C2 of the second side panel 18 is curved or rounded at a second end thereof. In alternative embodiments the cutaways may create upper corners C1, C2 having a different shape for example, but not limited to, a beveled or chamfered shape. In yet other embodiments employing a different style of end closure and/or access device, one or both of the cutaways at upper corners C1, C2 are omitted.

It will be appreciated that the fold line 13 between the first top panel 12 and the first side panel 14 is shorter than the fold line 15 between the first side panel 14 and the bottom panel 16. The fold line 13 terminates at a point distal from an end edge of the first side panel 14, which end is defined by the fold line 23*b*. Similarly, the fold line 19 is shorter than the fold line 17. The fold line 19 terminates at a point distal from an end edge of the second side panel 18, which is defined by the fold line 27*b*.

In alternative embodiments, the panel 22*b* may form a bevel panel; the bevel panel may be hinged to the first top panel 12 by an optioned fold line. The bevel panel may extend between the first top panel 12 and the seventh end closure panel 24*b* and the ninth end closure panel 28*b*. In still further embodiments the panel 22*b* may be omitted entirely such that an upper corner of the carton 90 is open. An uppermost and endmost, article B may be partially exposed to view.

It will be appreciated that providing the cutaways at the corners C1, C2 has the effect of removing the intersection between the fold line 13 and the fold line 23*b* and the intersection between the fold line 19 and the fold line 27*b*. The first side panel 14 comprises a cut edge between the hinged edge defined by the fold line 13 and the hinged edge defined by the fold line 23*b*. The cut edge being defined by the cutaway at the corner C1. The second side panel 18 comprises a cut edge between the hinged edge defined by the fold line 19 and the hinged edge defined by the fold line 27*b*. The cut edge is defined by the cutaway at the corner C2.

The sixth end closure panel 22*b* is configured to be bent or deformed, optionally folded or creased (optional fold lines may be provided in the sixth end closure panel 22*b* to facilitate folding), so as to conform to the shape of the rounded corners C1, C2. In this way, the upper end of the carton 90 is rounded or arcuate in shape. In this way, the carton 90 is optionally arranged to provide a close fit with the endmost articles B in the uppermost row of articles B. The articles B may be substantially cylindrical in shape and arranged such that a cylindrical axis is transversely oriented between the first and second side panels 14, 18. The sixth end closure panel 22*b* is deformed or bent around the outer surface of the uppermost, endmost article B; and the uppermost, endmost article B may act as mandrel for bending the sixth end closure panel 22*b*.

Optionally, the seventh end closure panel 24*b* is configured and arranged such that an end edge 80 of the seventh end closure panel 24*b* is non-parallel with the hinged edge of the seventh end closure panel 24*b* defined by the hinged connection 23*b*. In the illustrated embodiment, the end edge 80 is disposed divergently with respect to the hinged edge 23*b* towards the base panel 16 or toward the lower end edge of the seventh end closure panel 24*b*. Stated differently, the end edge 80 is configured to converge with the hinged connection 23*b* toward the cutaway provided at the corner C1.

Optionally, the seventh end closure panel 24*b* is configured and arranged such that a side edge 84 of the seventh end closure panel 24*b* is non-perpendicular with the hinged edge of the seventh end closure panel 24*b*, defined by the hinged connection 23*b*. In the illustrated embodiment, the side edge 84 is an upper edge of the seventh end closure panel 24*b* when a carrying handle (described below) is in use. The side edge 84 is disposed adjacent to the cutaway provided at the corner C1. In the illustrated embodiment the side edge 84 and the hinged edge (defined by the hinged connection 23*b*) define an angle therebetween, which angle is optionally greater than 90 degrees (in other words, is an obtuse angle).

Optionally, the ninth end closure panel 28*b* is configured and arranged such that an end edge 82 of the ninth end closure panel 28*b* is non-parallel with the hinged edge 27*b* of the ninth end closure panel 28*b* defined by the fold line 27*b*. In the illustrated embodiment the end edge 82 is configured to converge with the hinged edge 27*b* in the general direction of the second top panel 20. The end edge 82 is configured to converge with the hinged edge 27*b* toward the cutaway provided at the corner C2.

Optionally, the ninth end closure panel 28*b* is configured and arranged such that a side edge 86 of the ninth end closure panel 28*b* is non-perpendicular with the hinged edge 27*b* of the ninth end closure panel 28*b* defined by the fold line 27*b*. In the illustrated embodiment the side edge 86 is an upper edge of the ninth end closure panel 28*b* when the carrying handle is in use. The side edge 86 is disposed adjacent to the cutaway provided at the corner C2. In the illustrated embodiment the side edge 86 and the hinged edge 27*b* (defined by the fold line 27*b*) define an angle therebetween, which angle is optionally greater than 90 degrees (in other words, the angle is obtuse).

The cutaways provided at the corner C1, C2 can be considered to separate a portion of the top wall of the carton 90 from adjacent portions of the first and second side panels 14, 18. In particular the portion of the sixth end closure panel 22B which forms a part of the top wall of the carton 90 is separated from the adjacent portions of the first and second side panels 14, 18

The blank 10 comprises components for forming a handle structure H, which components are provided in part by the first top panel 12 and the second top panel 20, and in part by the first side panel 14 and the second side panel 18.

The handle structure H comprises a handle strap 36 struck from the second top panel 20; and a grip panel 32 struck from the first top panel 12.

The handle structure H comprises a first aperture A1, struck from the first top panel 12; the first aperture A1 defines a portion of the grip panel 32. The handle structure H comprises a second aperture A2, struck from the first top panel 12; the second aperture A2 defines another portion of the grip panel 32. The handle structure H comprises a first flap 34*a* hinged to a first side of the grip panel 32 by a fold line 33*a*. The handle structure H comprises a second flap 34*b* hinged to a second, opposing, side of the grip panel 32 by a fold line 33*b*. The first flap 34*a* and second flap 34*b*, when folded about the respective fold lines 33*a*, 33*b*, serve as cushioning flaps so as to provide a comfortable carrying handle when the handle structure H is in use.

A first end of the grip panel 32 is defined in part by first severance line 31. The first severance line 31 is orientated substantially perpendicularly to the fold line 13, so as to be arranged transversely with respect to a tubular axis of a tubular structure formed by the plurality of main panels 12, 14, 16, 18, 20 in a set up carton 90. The first severance line 31 is provided by a cut line interrupted by two connecting nick portions such that the structural integrity of the first top panel 12 is maintained during assembly of the blank 10 into the carton 90. In other embodiments, rather than the first severance line 31 being a frangible line, it may be formed by a complete cut line.

The handle structure H comprises a second severance line 37*a*. The second severance line 37*a* extends from an end of the second aperture A2 across the first top panel 12 and into the first side panel 14. Optionally, the second severance line 37*a* is arcuate, curved or curvilinear and terminates in the first side panel 14 with a "C" or "J" shaped outline.

The handle structure H comprises a third severance line 37*b*. The third severance line 37*b* extends from an end of the first aperture A1 across the first top panel 12 and optionally to a side edge thereof.

Optionally, the third severance line 37*b* is arcuate, curved or curvilinear and terminates at an optional recess R1 struck from a side edge of the first top panel 12.

The second severance line 37*a* and third severance line 37*b* are arranged divergently with respect to each other; extend from a second end of the grip panel 32; and define a transition of the grip panel 32 into the first top panel 12. The grip panel 32 and an end portion of the first top panel 12 are integrally formed so as to be continuous. The grip panel 32 and an end portion of the first top panel 12 provide a portion of the handle structure H which is disposed externally, in an external ply of a composite top wall of the carton 90. The external ply is formed from the first top panel 12. An internal ply is formed from the second top panel 20. The composite top panel 12/20 is formed from the first top panel 12 and the second top panel 20. In other embodiments the composite top wall comprises a third top panel which optionally acts as a cover panel and in such embodiments the "external ply" and "internal ply" strictly may both be internal of such a cover panel.

The handle strap 36 is disposed along a side edge of the second top panel 20. The handle strap 36 is defined in part by a third aperture A3 struck from the second top panel 20. The handle strap 36 is defined in part by fourth severance line 35 and fifth severance line 39*a*. The fourth severance line 35 comprises a plurality of linear cutlines. Each linear cutline is transversely offset with respect to its adjacent neighboring linear cutline. In this way the fourth severance line 35 is configured in a stepped fashion. The fourth severance line 35 comprises a riser between each pair of adjacent neighboring linear cutlines. The fourth severance line 35 extends into the fifth end closure panel 30*a* and terminates therein with a "C" or "J" shaped cutline. The steps of the fourth severance line 35 are arranged so as to progressively step closer to the hinged connection 19 (defined by the fold line 19) between the second top panel 20 and the second side panel 18, as the fourth severance line 35 extends towards the center of the second top panel 20. In this way the handle strap 36 becomes wider towards the center of the second top panel 20. This allows a portion of the handle strap 36 to freely slide inwardly towards the center with respect to the inner top panel 20. The risers of the steps do not inhibit movement of the handle strap 36. The risers may have a depth of less than 1 mm and optionally three steps and two risers are provided.

Optionally, the risers are configured as nicks or connecting portions, each of which initially couples the handle strap 36 to the adjacent portion of the second top panel 20. In this way the connecting portions hold the handle strap 36 in position adjacent to the second top panel 20. Since the connecting portions are transversely offset with respect to each other, and with respect to the adjacent ends of the linear cutlines forming the steps, the strength of the coupling between the handle strap 36 and the second top panel 20 is improved.

The fifth severance line 39*a* extends from an end of the third aperture A3 across the second top panel 20 and into the second side panel 18. Optionally, the fifth severance line 39*a* is arcuate, curved or curvilinear and terminates in the second side panel 18 with a "C" or "J" shaped cutline.

The handle structure H comprises a tab 42 struck from the first end closure panel 22*a*. The tab 42 is defined in part by a substantially (square) "U" shaped cut line 41 which may interrupt the fold line 21*a*. The tab 42 is secured to a portion of the handle strap 36 provided by the fifth end closure panel 30*a* when the carton 90 and the handle structure H are formed. The tab 42 allows an end portion of the handle strap 36 to be displaced inwardly of the carton 90 such that a portion of the handle strap 36 can be displaced upwardly through an opening defined by the apertures A1 and A2 in the first top panel 12.

In an assembled or erected state, the first top panel 12 and the second top panel 20 are disposed in an overlying relationship with each other. The first top panel 12 is disposed outermost; the first top panel 12 forms an outer ply of the composite top wall 12/20. The second top panel 20 is disposed innermost; the second top panel 20 forms an inner ply of the composite top wall 12/20.

Optionally, the handle strap 36 comprises a protrusion or tab 70. The tab 70 protrudes from a side edge of the handle strap 36 and is disposed proximate an end of a grip portion of the handle strap 36 (defined at least in part by the grip panel 32 struck from the first top panel 12). The optional recess R1 may be provided to allow nesting of a plurality of blanks 10 when being struck from a standard sized sheet of material in order to optimize the number of complete blanks 10 that may be cut from such a sheet.

Optionally, the blank 10 comprises a recess or cutaway R2 in the second end closure panel 24*a*. Optionally, the blank 10 comprises a recess or cutaway R3 in the fourth end closure panel 28*a*. The cutaway R2 and the cutaway R3 are configured such that when the second end closure panel 24*a* and the fourth end closure panel 28*a* are folded to close the end of the tubular structure formed by the main panels 12, 14, 16, 18, 20 the tab 42 is exposed to view. That is to say the second end closure panel 24*b* and the fourth end closure panel 28*a* do not overlay the tab 42. In this way the tab 42 is free from the second and fourth end closure panels 24*a*, 28*a* and the tab 42 is free to move with respect thereto. In alternative embodiments in which the cutaways R2, R3 are omitted application of glue or other adhesive treatment may be configured to avoid securing the tab 42 to the second and/or fourth end closure panels 24*a*, 28*a*; this may include application or use of an inhibitor to prevent adhesion of the tab 42 to the second and/or fourth end closure panels 24*a*, 28*a*.

The carton 90 can be formed by a series of sequential folding operations in a straight line machine so that the carton 90 may not be required to be rotated or inverted to complete its construction. The folding process is not limited to that described below and may be altered according to particular manufacturing requirements. During loading and assembly of the carton 90, the carton 90 may be orientated such that the first side panel 14 (or in alternative embodiments the second side panel 18) forms a loading surface. The bases of one or more articles B may be in sliding contact with the loading surface when being inserted into the carton 90. The articles B may be substantially cylindrical in shape and have a cylindrical axis. In this way the cylindrical axis is orientated perpendicularly to the first side panel 14 and may also be orientated substantially vertically. The main panel 16 forms the base panel (base wall) 16 when the handle structure H is in use as a carrying handle by a user and this base wall 16 is, optionally, disposed adjacent to the sides of the articles B. The main panels 12, 20 form the composite top wall 12/20 of the carton 90 when the handle structure H is in use as a carrying handle by a user. In this orientation the composite top wall 12/20 is, optionally, disposed adjacent to the sides of the articles B. The composite top wall 12/20 may not be disposed substantially planar to the tops or bottoms of the articles B held within the carton 90. In other words, the cylindrical axis of the articles B is substantially parallel with the plane of the top wall 12/20 of the carton 90. The main panel 16 may also form the base wall 16 when the articles B are being dispensed from the carton 90 or when the carton 90 is at rest upon a surface such as a shelf. As such, it will be understood that descriptive terms "top", "base", and "side" do not necessarily limit the carton 90 to adopting a particular orientation, but serve to distinguish those panels from one another. In other embodiments the cylindrical axis of the articles B may be orientated differently with respect to the composite top wall 12/20 of the carton 90. For example, but without limitation, the cylindrical axis of the articles B may be orientated substantially perpendicularly to the plane of the composite top wall 12/20 of the carton 90.

Turning to the construction of the carton 90 as illustrated in FIG. 2, the blank 10 is folded about the fold line 17 such that the second side panel 18 is disposed in overlying relationship with the base panel 16 and such that the second top panel 20 is disposed in face contacting relationship with the first side panel 14.

Glue G or other adhesive treatment is applied to an outer surface of the second top panel 20. Glue G or other adhesive treatment is applied to portions of an outer surface of the handle strap 36. Alternatively, glue G or other adhesive treatment may be applied to corresponding portions of an inner surface of the first top panel 12. An unsecured region of the handle strap 36, struck from the second top panel 20 and defined in part by the section of the stepped fourth severance line 35 disposed in the second top panel 20, is free from adhesive. In some embodiments an inhibitor may be applied to the unsecured region to prevent the unsecured region from being secured to the first top panel 12.

The blank 10 is folded about the fold line 13 such that the first top panel 12 is disposed in overlying relationship with the second top panel 20 and the first side panel 14. The first top panel 12 is thereby secured to appropriate regions of the second top panel 20 and handle strap 36. The composite top wall 12/20 is thereby formed.

The blank 10 is thus formed into a flat collapsed tubular structure which can be readily shipped or distributed to a convertor plant, at which the flat collapsed tubular structure may be erected into an open ended tubular structure and loaded with articles B.

The flat collapsed tubular structure may be erected to form an open ended tubular structure by unfolding the second side panel 18 with respect to the base panel 16 such that the second side panel 18 is disposed substantially perpendicularly with respect to the base panel 16.

The carton 90, in its open ended tubular form, may be loaded with articles B through one or both open ends thereof. It will be appreciated that in some embodiments one of the open ends of the carton 90 may be closed before loading the interior with articles B through the remaining open end.

Once the carton 90 has been loaded with articles B the open ends of the carton 90 are closed.

A first end of the tubular structure is closed by folding the first end closure panel **22*a* together with the fifth end closure panel 30*a* about fold lines 21*a* and 29*a* respectively. The third end closure panel 26*a* is folded about fold line 25*a***.

Optionally, glue or other adhesive treatment is applied to an outer surface of the first end closure panel **22*a*, or in alternative embodiments to an inner surface of the third end closure panel 26*a***.

The second end closure panel **24*a* is then folded about the fold line 23*a* to be brought into contact with the first and third end closure panels 22*a*, 26*a*** and optionally is adhesively secured thereto.

Glue or other adhesive treatment is applied to an outer surface of the second end closure panel **24*a*, or in alternative embodiments to an inner surface of the fourth end closure panel 28*a***.

The fourth end closure panel **28*a* is then folded about the fold line 27*a* to be brought into contact with at least the second end closure panel 24*a*** and is secured thereto.

In alternative embodiments the second end closure panel **24*a* may be folded about fold line 23*a* after folding the fourth end closure panel 28*a* about fold line 27*a*. It will be appreciated that in such embodiments the second end closure panel 24*a*** is disposed outermost.

A second end of the tubular structure is closed by folding the sixth end closure panel **22*b* with respect to the first top panel 12 and by folding the eighth end closure panel 26*b* about fold line 25*b***.

The sixth end closure panel **22*b* is bent or deformed, optionally folded or creased, so as to conform to the shape of the rounded corners C1, C2. In this way the upper end of the carton 90 is rounded or arcuate in shape. The carton 90 is thus arranged to provide a close fit with the articles B. The articles B may be substantially cylindrical in shape and arranged such that a cylindrical axis is transversely orientated between the first and second side panels 14, 18. The sixth end closure panel 22*b* is deformed or bent around the outer surface of the uppermost endmost article B. Said article B may act as mandrel for bending the sixth end closure panel 22*b***.

Glue or other adhesive treatment is applied to an outer surface of the sixth end closure panel **22*b*, or in alternative embodiments to an inner surface of the ninth end closure panel 28*b***.

Glue or other adhesive treatment is applied to an outer surface of the eighth end closure panel **26*b*, or in alternative embodiments to an inner surface of the ninth end closure panel 28*b***.

The ninth end closure panel **28*b* is then folded about the fold line 27*b* to be brought into contact with the sixth and eighth end closure panels 22*b*, 26*b*** and is adhesively secured thereto.

Optionally, glue or other adhesive treatment is applied to an outer surface of the sixth end closure panel **22*b*, or in alternative embodiments to an appropriate region of the inner surface of the seventh end closure panel 24*b***.

Optionally, glue or other adhesive treatment is applied to an outer surface of the eighth end closure panel **26*b*, or in alternative embodiments to an appropriate region of the inner surface of the seventh end closure panel 24***b*.

Glue or other adhesive treatment is applied to an outer surface of the ninth end closure panel 28*b*, or in alternative embodiments to an appropriate region of the inner surface of the seventh end closure panel 24*b*.

The seventh end closure panel 24*b* is then folded about the hinged connection 23*b* to be brought into contact with at least the ninth end closure panel 28*b* and is secured thereto.

In other embodiments alternative securing means may be employed to secure the end closure panels 22*a*, 24*a*, 26*a*; 28*a*, 30*a*, 22*b*, 24*b*, 26*b*, 28*b* for example, but not limited to, mechanical locking devices such as staples or punch locks integrally formed within the end closure panels 22*a*, 24*a*, 26*a*, 28*a*, 30*a*; 22*b*, 24*b*, 26*b*, 28*b*.

Figure 3:
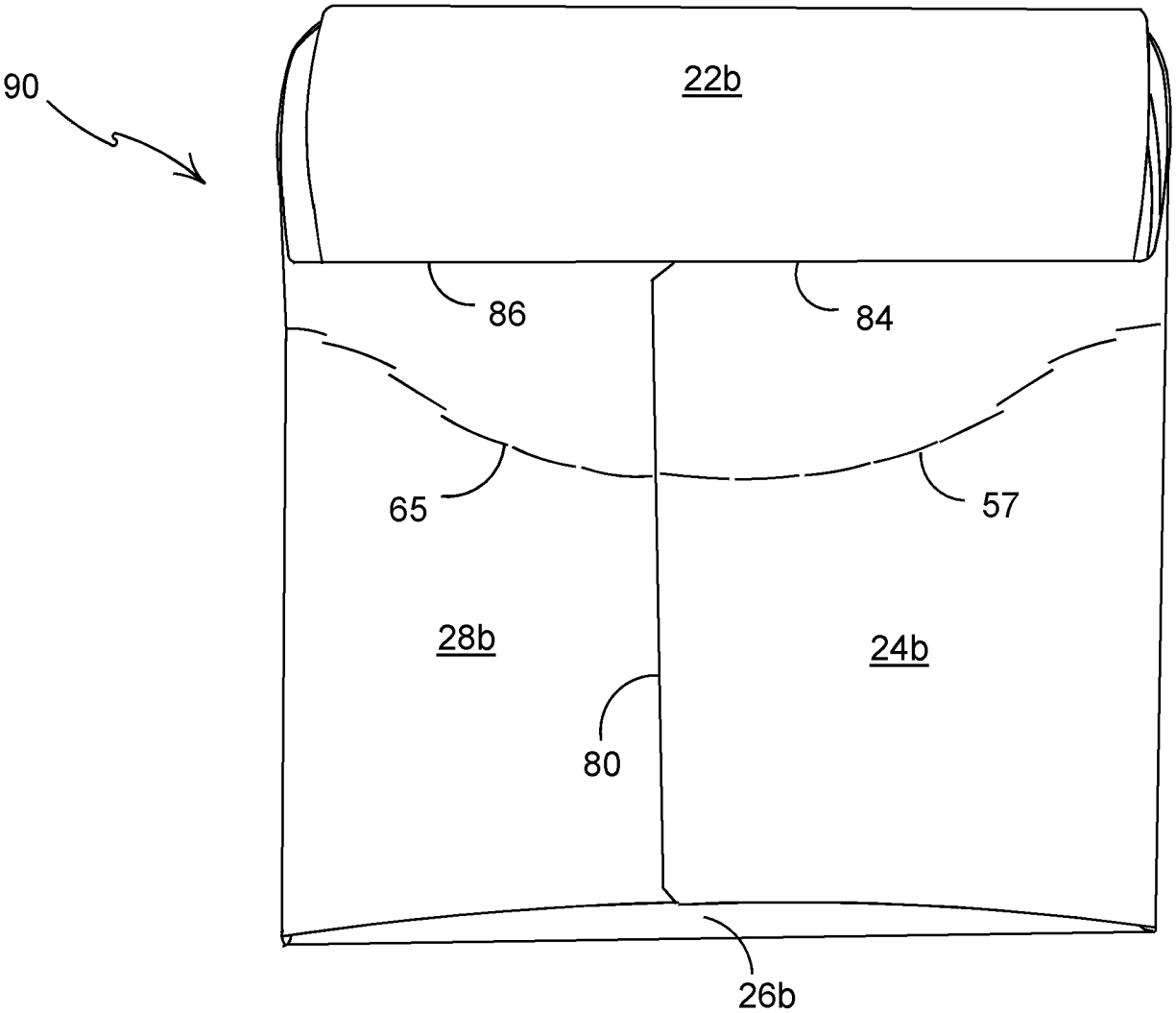
FIG. 3 is an end view of the carton of FIG. 2.
Figure 4:
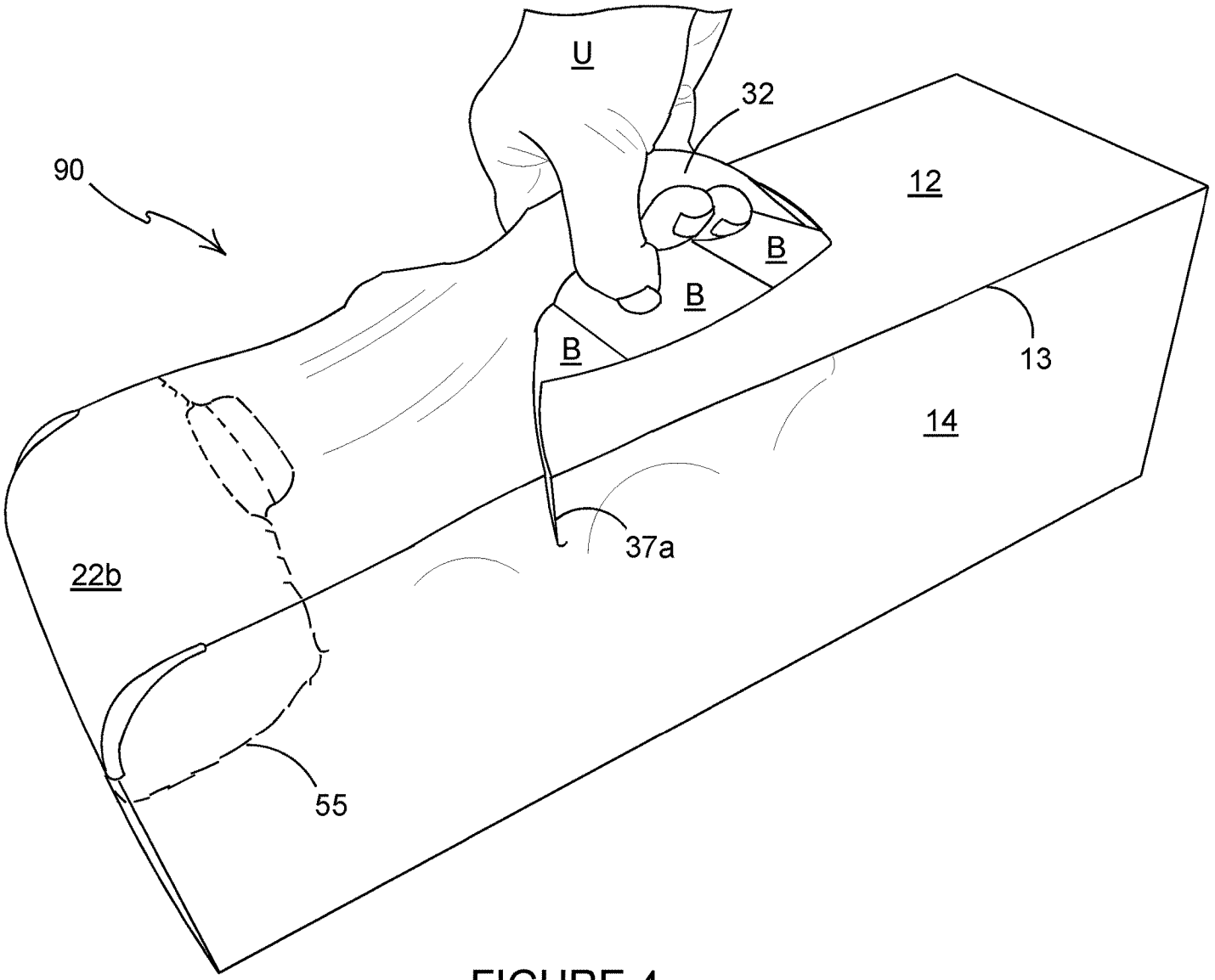
FIG. 4 is a perspective view from above of the carton of FIG. 2 showing the handle structure in a deployed condition.
Figure 5:
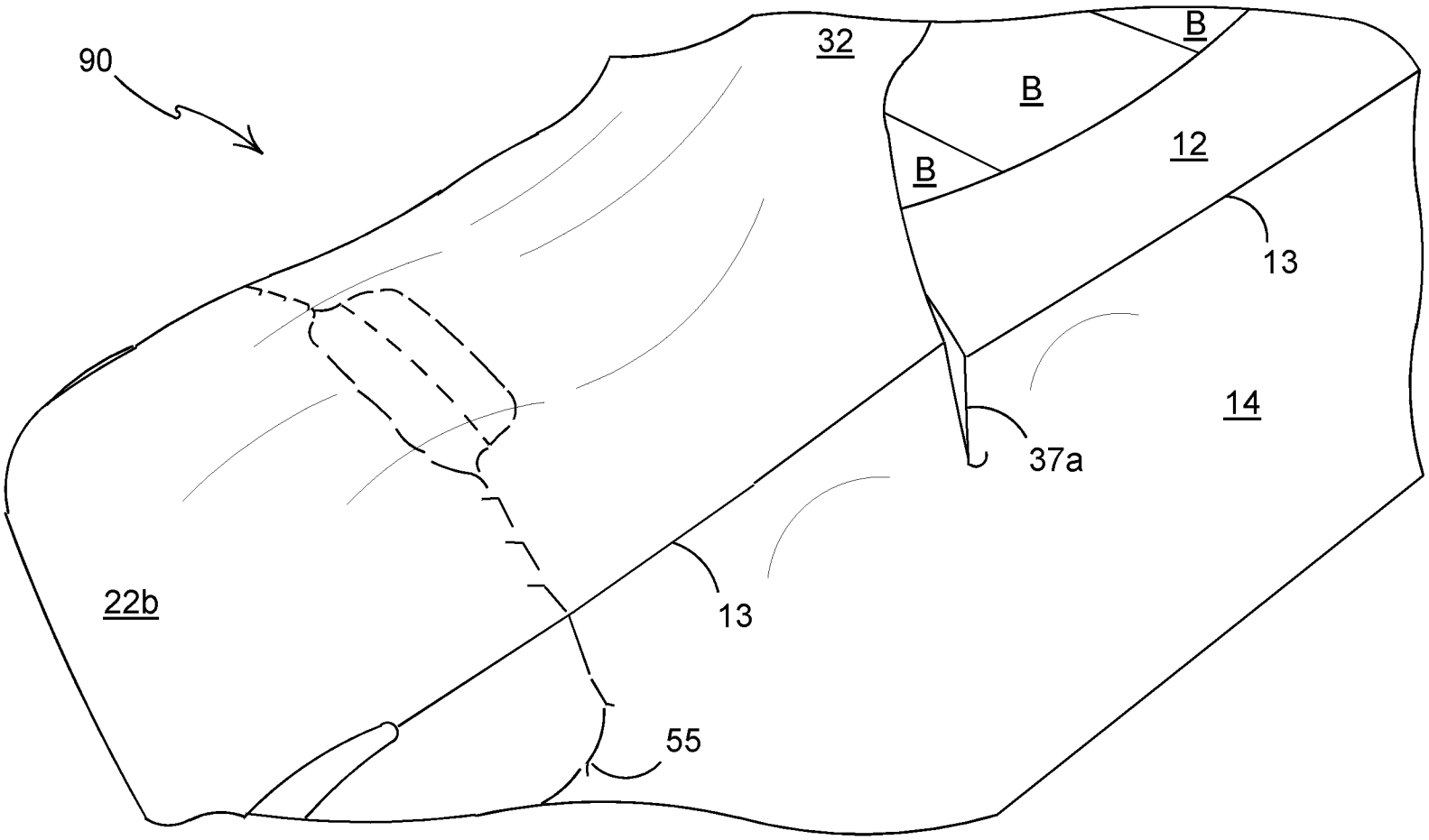
FIG. 5 is an enlarged perspective view from above of a portion of the carton of FIG. 4.
Figure 6:
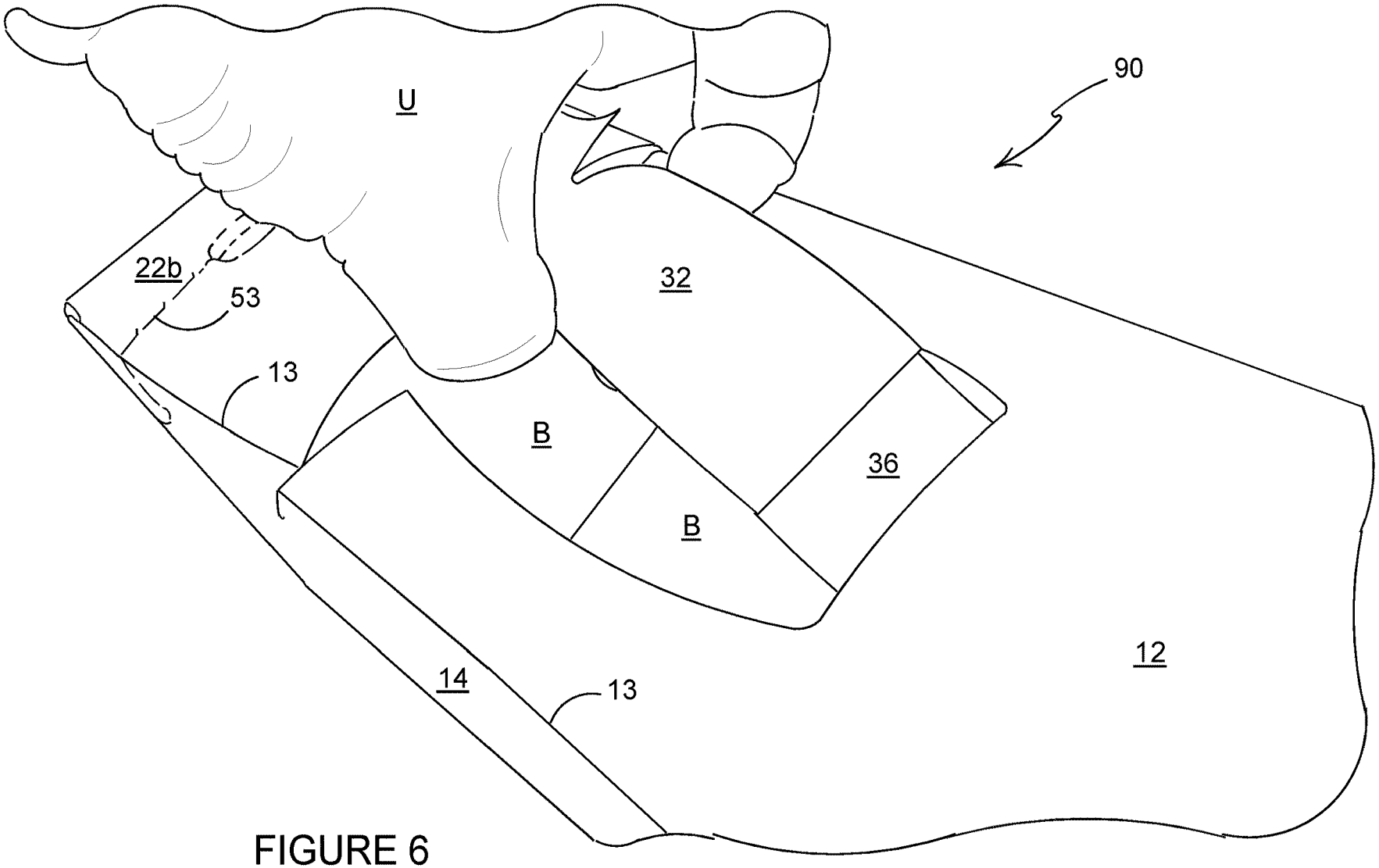
FIG. 6 is an alternative perspective view from above of a portion of the carton of FIG. 4.

A completed carton 90 is shown in FIGS. 2 and 3. FIGS. 4, 5 and 6 illustrate the handle structure H, in a deployed condition, being used as a carrying handle for the carton 90. The carton 90 comprises an interior volume defined by the main panels 12, 14, 16, 18, 20 forming the tubular structure and the end closure panels 22*a*, 24*a*, 26*a*; 28*a*, 30*a*, 22*b*, 24*b*, 26*b*, 28*b*. The interior volume is loaded with articles B. The articles B are arranged in rows. The handle structure H is located in the top wall 12/20. Once the handle structure H is assembled, the third severance line 37*b* and the fifth severance line 39*a* are aligned with one another. A portion of the fifth severance line 39*a* is in vertical registry with third severance line 37*b* and together the fifth and third severance lines 39*a*, 37*b* form a contiguous severance line extending from the grip panel 32, in the composite top wall 12/20, into the second side wall 18.

The second severance line 37*a*, the third severance line 37*b* and fifth severance line 39*a* form a first relief structure which extends from the composite top wall 12/20 into the first and second side walls 14, 18.

The severance line formed from the third severance line 37*b* and fifth severance line 39*a* is arranged to be disposed adjacent to a void space in a loaded carton 90. The void may be formed between two adjacent articles B.

The second severance line 37*a* is arranged to be disposed adjacent to a void space in a loaded carton 90. The void may be formed between two adjacent articles B. FIG. 1 illustrates the positions P of the articles B with respect to the second side panel 18. The second severance line 37*a* extends into the second side panel 18 so as to be disposed adjacent to a void between a first article B disposed at a first position P1 and a second article B disposed at a second position P2.

Optionally, the second severance line 37*a* and the fifth severance line 39*a* terminate in the respective first or second side panel 14, 18 at a location proximate to a side wall of an article B disposed therein. In this way, the relief structures may direct load forces or stresses in the material from which the carton 90 is formed to a region of the carton 90 which is supported by an article B. The article B may act as a brace between first and second side panels 14, 18.

When the handle structure H is deployed to form a carrying handle a user engages or grasps the grip panel 32 disposed between the apertures A1, A2, and engages or grasps the portion of the handle strap 36 that is secured to the underside of the grip panel 32.

As the user attempts to pull the grasped grip panel 32 and associated handle strap 36 (which together form a grip portion of the handle structure H), the first severance line 31 is severed such that the first end of the grip panel 32 is detached from the first top panel 12. A portion of the handle strap 36 provided in the fifth end closure panel 30*a* and the tab 42 are displaced inwardly of the carton 90 into an adjacent void within the loaded carton 90.

A portion of the handle strap 36 that is disposed below a region of the first top panel 12 that is defined between the first end closure panel 22*a* and the first end of the grip panel 32, is moved or is slid below the first top panel 12 and towards the opening in the composite top wall 12/20 defined in part by the apertures A1, A2.

The grip panel 32 is displaced upwardly and a portion of the handle strap 36 passes through the opening in the first top panel 12, as is best shown in FIG. 6. A grasped part of the handle structure H stands above the composite top wall 12/20.

Regions of the first and second side panels 14, 18 disposed proximate the second severance line 37*a* and the fifth severance line 39*a* are displaced inwardly of the carton 90, as an end region of the composite top wall 12/20 is deformed and displaced upwardly, as shown in FIGS. 4, 5 and 6. In this way the relief structure formed from the second severance line 37*a*, the third severance line 37*b* and fifth severance line 39*a* reduces localized stress established in the carton 90, in particular in the composite top wall 12/20, around the apertures A1, A2. This prevents, or at least reduces, the likelihood of tears propagating when the handle structure H is in use and the weight of the loaded carton 90 is substantially depending therefrom.

The handle structure H forms a carrying handle comprising a first end portion that is formed from the first, outer, top panel 12 and which deforms above the at rest plane of the top panel 12 when the carrying handle is deployed. The carrying handle also comprises a grip portion that is formed by the first, outer, top panel 12 and optionally a portion of the second top panel 20. The grip portion of the carrying handle extends from the first end portion into the access opening in the composite top wall 12/20 and in this embodiment is provided by the grip panel 32 and a medial portion of the handle strap 36. The carrying handle also comprises a second end portion that is disposed under the first, outer, top panel 12 and that is also joined to the grip portion.

The second severance line 37*a* and the third and fifth severance lines 37*b*, 39*a* form relief cuts extending from the grip portion, and define in part the first end portion. The relief cuts optionally extend into the side walls 14, 18 of the carton 90 and optionally are located between the ends of two cylindrical articles B in the carton 90.

The seventh and ninth end closure panels 24*b*, 28*b* comprise end edges 80, 82 respectively which are non-parallel with their respective hinged connections 23*b*, 27*b* to the first or second side panels 14, 18. The seventh and ninth end closure panels 24*b*, 28*b* comprise upper edges 84, 86 respectively which are non-perpendicular with their respective hinged connections 23*b*, 27*b* to the first or second side panels 14, 18. When the carton 90 is assembled or erected, the upper edges 84, 86 of the seventh and ninth end closure panels 24*b*, 28*b* are substantially collinear and are arranged to be substantially perpendicular to the hinged connections 23*b*, 27*b* between the seventh and ninth end closure panels 24*b*, 28*b* and the respective first or second side panels 14, 18, as can be seen in FIG. 3. The upper edges 84, 86 of the seventh and ninth end closure panels 24*b*, 28*b* are substantially parallel with the hinged connection 25*b* between the eighth end closure panel 26*b* and the base panel 16. The end edges 80, 82 (only the end edge 80 is visible in FIG. 3) of the seventh and ninth end closure panels 24*b*, 28*b* are substantially parallel with the hinged connections 23*b*, 27*b* between the seventh and ninth end closure panels 24*b*, 28*b* and the respective first or second side panels 14, 18.

It has been found that providing the cutaways at the corners C1, C2 of the first and second side panels 14, 18 reduces the rigidity of the carton 90 in the region proximate the cutaways and that the first and second side walls 14, 18 tend to bend inwardly or converge towards each other as they approach the corners C1, C2. That is to say each of the first and second side walls 14, 18 deviates from a perpendicular orientation with respect to the base panel 16. As a consequence, the seventh end closure panel 24*b* and the ninth end closure panel 28*b* appear to be skewed when in a folded condition.

This occurs as a consequence of the handling of the carton by a packaging machine during loading and assembly of the package. Typically, the carton is conveyed upon a conveyor in a packaging machine such that the carton is at rest upon one of the first or second side panels 14, 16; the composite top panel 12, 20 is arranged on the conveyor to be a leading panel, the bottom panel 16 is arranged onto conveyor to be a trailing panel. The articles B are loaded into the carton through an open end by sliding the articles upon the one of the first and second side panels 14, 18 which has been placed in face contacting relationship with the conveyor. In order to close the ends of the carton, once the articles are loaded, a fixed or static guide may be employed to fold the seventh and/or ninth end closure panels 24, 28*b*. In those embodiments in which carton is at rest upon the second side panel; the fixed or static guides apply a force to the seventh end closure panel 24*b* forcing the seventh end closure panel 24*b* in a downward direction and in an upstream direction. The seventh end closure panel 24*b* is forced in an upstream direction since the carton is continuously moving a downstream direction on the packaging machine whilst the seventh end closure panel 24*b* is in contact with the fixed or static guide as it is being folded. The seventh end closure panel 24*b* is in frictional contact with the fixed or static guide which causes drag up the seventh end closure panel 24*b* and since the seventh end closure panel 24*b* is in hinged connection with the first side panel 14, this downward and upstream force is transferred to the first side panel 14. Similarly, the ninth end closure panel 28*b* is forced upwardly and in an upward direction and in an upstream direction by a separate static guide. This has the effect, in a setup carton 90, of forcing the the first and second side walls 14, 18 to bend inwardly or converge towards each other as they approach the corners C1, C2.

Therefore, adjustment of the shape of the seventh and ninth end closure panels 24*b*, 28*b* is advantageous and beneficially so that the end edge 80 appears to be substantially vertical, or at least perpendicular to the hinged connection between the eighth end closure panel 26*b* and the base panel 16. The upper edges 84, 86 of the seventh and ninth end closure panels 24*b*, 28*b* are substantially collinear and appear to be substantially parallel to the hinged connection between the eighth end closure panel 26*b* and the base panel 16. It is believed that providing the cutaways at the corners C1, C2 of the first and second side panels 14, 18 has the effect of removing the bracing effect of the top panel 12 between the first and second side panels 14, 18, thus allowing the upper region of the carton 90 as shown in FIG. 3 to be tightened more than the lower region.

The shape adjustment in shape of the seventh and ninth end closure panels 24*b*, 28*b* can be employed with any carton in which the fold line 13 does not intersect with the fold line 23*b* and the fold line 19 does not intersect with the fold line 27*b*. For example, but not limited to, when the fold lines 13, 19 are shorter in length than the length of the respective one of the first or second side panels 14, 18; such as when the first or second top panel 12, 20 is shorter in length than each of the first and second side panel 14, 18.

Figure 7:
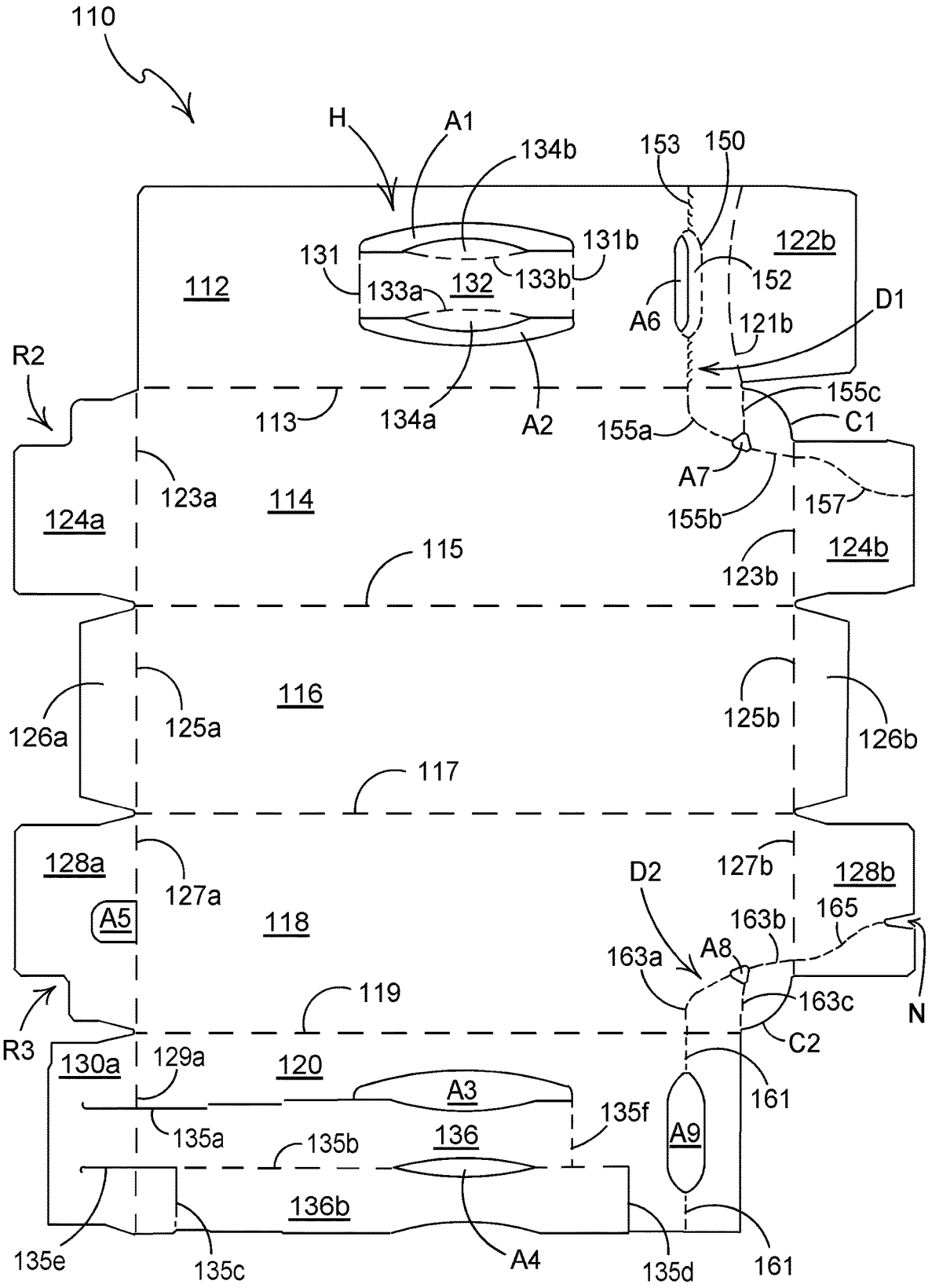
FIG. 7 is a plan view from above of a blank for forming a carton according to another embodiment of the present disclosure.
Figure 8:
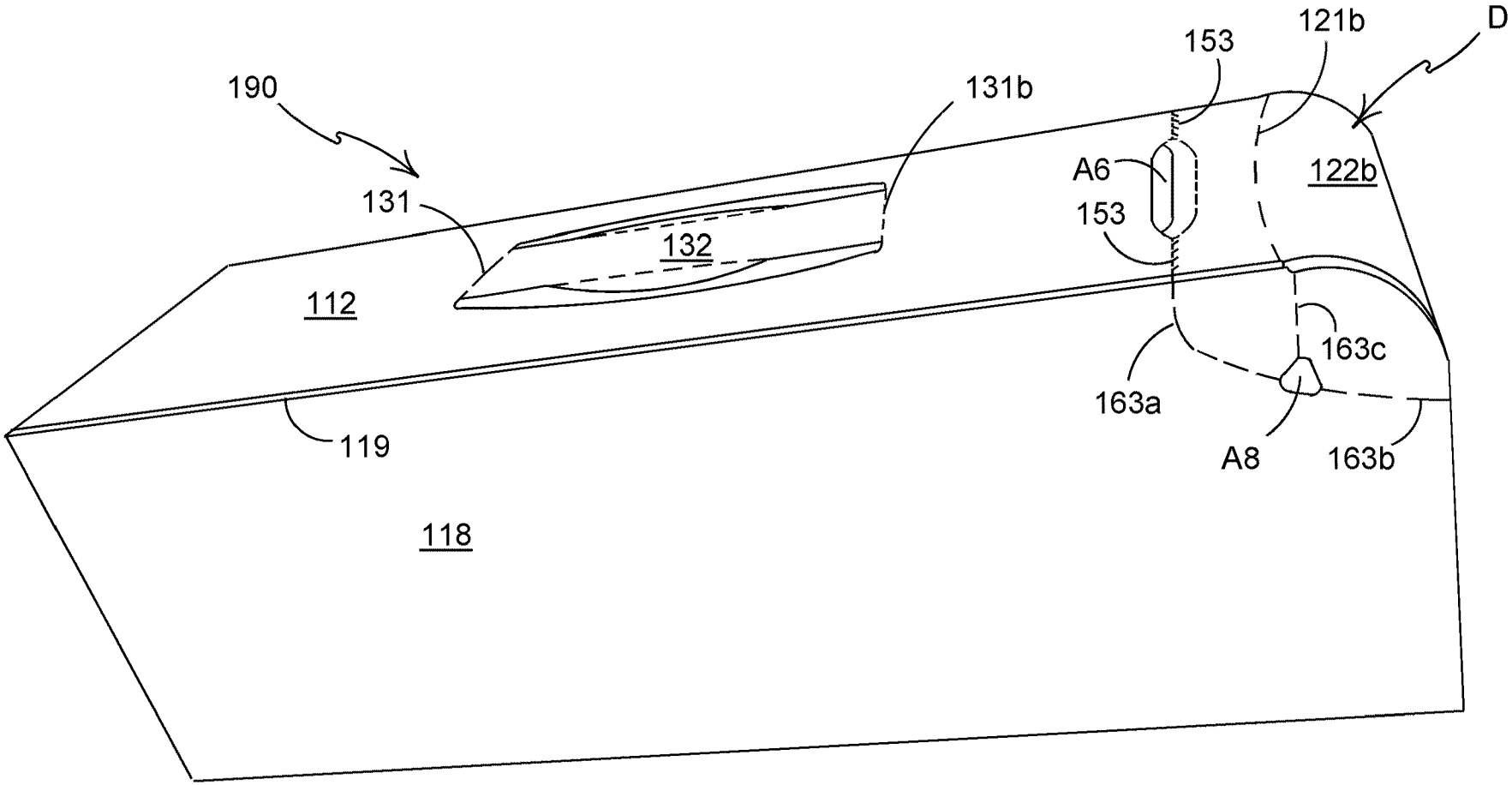
FIG. 8 is a perspective view from above of a carton formed from the blank of FIG. 7.

Referring now to FIGS. 7 and 8, there is shown an additional embodiment of the present disclosure. In the second illustrated embodiment, like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 6 will be described in detail.

FIG. 7 illustrates a blank 110 for forming a carton 190 as shown in FIG. 8, according to a second illustrated embodiment.

The blank 110 comprises a plurality of main panels 112, 114, 116, 118, 120 hinged together in a linear series. The plurality of main panels 112, 114, 116, 118, 120 form a tubular structure in a set up condition.

Similarly to the blank 10 of the first embodiment, the blank 110 comprises a base panel 112 hinged to a first side panel 114 by a fold line 113. The first side panel 114 is hinged to a top panel 116 by a fold line 115. The top panel 116 is hinged to a second side panel 118 by a fold line 117. The second side panel 118 is hinged to a securing panel 120 by a fold line 119.

Again a series of end closure panels 124*a*, 126*a*, 128*a*, 130*a*; 122*b*, 124*b*, 126*b*, 128*b* are provided for fully closing each end of the carton 190. It can be seen that the first end closure panel 22*a* of the blank 10 of FIG. 1 has been omitted in this second embodiment.

The blank 110 comprises an aperture A5 struck from within the fourth end closure panel 128*a*; aperture A5 has a substantially square shape rather than the circular shape of the first embodiment of FIG. 1. In an assembled or erected carton the aperture A5 provides a handling device facilitating removal of the carton 190 from a shelf or stack of similar cartons 190. Provision of aperture A5 is entirely optional.

The blank 110 comprises an optional access device or dispenser. The access device comprises a plurality of weakened lines of severance 153, 155*a*, 155*b*, 155*c*, 157, 161, 163*a*, 163*b*, 163*c*, 165. The access device is defined by a first portion D1 and a second portion D2, as shown in FIG. 7.

The first portion D1 comprises a first weakened line of severance 157 that commences from a side edge of the seventh end closure panel 124*b*. The first weakened line of severance 157 extends across the seventh end closure panel 124*b*. The first weakened line of severance 157 is continuous with a second weakened line of severance 155*a*/155*b* provided in the first side panel 114. The second weakened line of severance 155*a*/155*b* is interrupted by an aperture A7 struck from the first side panel 114; the aperture A7 is optionally substantially triangular in shape. The second weakened line of severance 155*a*/155*b* extends from an end edge of the first side panel 114 (defined by a hinged connection 123*b* between the first side panel 114 and the seventh end closure panel 124*b*) to an adjacent side edge of the first side panel 114 (defined by a hinged connection 113 between the first side panel 114 and the first top panel 112).

A third weakened line of severance 153 is provided in the first top panel 112 and is continuous with the second weakened line of severance 155*a*/155*b*. The third weakened line of severance 153 extends across the first top panel 112.

The third weakened line of severance 153 is interrupted by a tear initiation device comprising a tab 152 and an aperture A6. The tab 152 is struck from the first top panel 112 and hinged thereto by a fold line 150. The tab 152 is defined in part by the aperture A6.

An eighth weakened line of severance 155*c* extends from the generally triangular aperture A7 to an edge of the first side panel 114 defined by a cutaway at the corner C1.

The second portion D2 comprises a fifth weakened line of severance 165 that commences from a slot or notch N provided in a side edge of the ninth end closure panel 128*b*. The notch N extends from a side edge of the ninth end closure panel 128*b* and partially thereacross. The notch N is dimensioned to be substantially equal in length to the lateral distance of overlap between the seventh and ninth end closure panels 124*b*, 128*b* when the blank 110 is assembled or erected into the carton 190. The fifth weakened line of severance 165 extends across the ninth end closure panel 128*b*. The fifth weakened line of severance 165 is continuous with a sixth weakened line of severance 163*a*/163*b* provided in the second side panel 118. The sixth weakened line of severance 163*a*/163*b* is interrupted by an aperture A8 struck from the second side panel 118. The aperture A8 is optionally substantially triangular in shape. The sixth weakened line of severance 163*a*/163*b* extends from an end edge of the second side panel 118 (defined by a hinged connection 127*b* between the second side panel 118 and the ninth end closure panel 128*b*) to an adjacent side edge of the second side panel 118 (defined by hinged connection 119 between the second side panel 118 and the second top panel 120).

A seventh weakened line of severance 161 is provided in the second top panel 120 and is continuous with the sixth weakened line of severance 163*a*/163*b*. The seventh weakened line of severance 161 extends across the second top panel 120 and is interrupted by an aperture A9. Aperture A9 is configured and arranged to be substantially in vertical registry with the tear initiation device in the first top panel 112 in the carton 190.

A ninth weakened line of severance 163*c* extends from the generally triangular aperture A8 to an edge of the second side panel 118 defined by a cutaway at the corner C2.

A fold line 121*b* is provided in the sixth end closure panel 122*b*. The fold line 121*b* extends transversely across the sixth end closure panel 122*b*. The fold line 121*b* is curved or arcuate in shape. The fold line 121*b* may assist a user to direct force in the sixth end closure panel 122*b* towards the eighth weakened line of severance 155*c* and the ninth weakened line of severance 163*c* to facilitate severance thereof when the access device is deployed.

The blank 110 comprises a handle structure H; the handle structure H comprises a handle strap 136 struck from the second top panel 120 and grip panel 132 struck from the first top panel 112.

The handle structure H comprises a first aperture A1, struck from the first top panel 112; the first aperture A1 defines a portion of the grip panel 132. The handle structure H comprises a second aperture A2, struck from the first top panel 112; the second aperture A2 defines another portion the grip panel 132. The handle structure H comprises a first flap 134*a* hinged to a first side of the grip panel 132 by a fold line 133*a*. The handle structure H comprises a second flap 134*b* hinged to a second, opposing, side of the grip panel 132 by a fold line 133*b*. The first flap 134*a* and second flap 134*b*, when folded about the respective fold lines 133*a*, 133*b*, again serve as cushioning flaps so as to provide a comfortable carrying handle when the handle structure H is in use.

The grip panel 132 is defined in part at a first end by first severance line 131. The first severance line 131 is orientated substantially perpendicularly to the fold line 113, so as to be arranged transversely with respect to a tubular axis of a tubular structure formed by the plurality of main panels 112, 114, 116, 118, 120 in the carton 190.

The handle structure H comprises an optional fold line 131*b* at a second end of the grip panel 132.

The severance lines forming the relief structure of the embodiment of FIG. 1 have been omitted.

The handle structure H comprises an optional reinforcing strap 136*b*. The reinforcing strap 136*b* is struck from the second top panel 120 and is optionally hinged to the handle strap 136 by a fold line 135*b*.

A first end of end of the handle strap 136 is defined in the fifth end closure panel 130*a* in part by a section of the stepped severance line 135*a* and in part by a cut line 135*e*. Cutline 135*e* is substantially collinear with the fold line 135*b*. An aperture A4 is struck from the second top panel 120 between the handle strap 136 and the reinforcing strap 136*b* and defines in part a grip portion of the handle strap 136. Cutlines or weakened lines of severance 135*c*, 135*d* are provided in the second top panel 120 and define first and second ends of the reinforcing strap 136*b* respectively.

The handle strap 136 optionally comprises fold line 135*f* which defines a second end of the handle strap 136 disposed in the second top panel 120.

The reinforcing strap 136*b* may be folded about the fold line 135*b* and secured to the handle strap 136 so as to strengthen the handle structure H.

The carton 190 is otherwise assembled in a manner substantially similar to that described previously in relation to the embodiment of FIGS. 1 to 6.

The handle structure H can be deployed in a similar manner to the method of deployment of the handle structure H of to the embodiment of FIGS. 1 to 6 previously described. The The handle structure H forms a carrying handle comprising a first end portion that is formed from the first, outer, top panel 112 and which deforms above the at rest plane of the top panel 112 when the carrying handle is deployed. The carrying handle also comprises a grip portion that is formed by the first, outer, top panel 112 and optionally a portion of the second top panel 20. The grip portion of the carrying handle extends from the first end portion of the handle structure into the access opening in the composite top wall 12/20 and in this embodiment is provided by the grip panel 32 and a medial portion of the handle strap 36. The carrying handle also comprises a second end portion that is disposed under the first, outer, top panel 112; the second end portion is joined to the grip panel 32.

Blanks 10, 110 are configured for forming a fully enclosed carton 90, 190 of the end loading type. The handle structure H is not limited in its application to such a carton 90, 190 or carrier 90, 190. It will be understood that one or more handle structures H may be applied to a carton or carrier 90, 190 and that the carton or carrier 90, 190 may be tubular, fully enclosed, partially enclosed, of the wraparound type and/or of the top gripping type.

It can be appreciated that various changes may be made within the scope of the present invention. For example, the size and shape of the panels and apertures may be adjusted to accommodate articles of differing size or shape. Whereas handle structures of the disclosure have been described and illustrated when applied to a fully enclosed carton of the end loading type, in other applications and embodiments one or more handle structures according to the disclosure may be applied to a carton or carrier that is fully enclosed, partially enclosed, of the wraparound type and/or of the top gripping type.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the term "hinged connection" and "fold line" each refers to all manner of lines that define hinge features in a substrate of sheet material, for facilitating folding portions of the substrate with respect to one another, or otherwise for indicating optimal folding locations in the substrate. For example, a hinged connection should not be construed as necessarily referring to a single fold line only: indeed a hinged connection can be formed from one or more fold lines.

As used herein, the term "fold line" refers to one of the following: a scored line, an embossed line, a debossed line, a line of perforations, a line of short slits, a line of half-cuts, a single half-cut, an interrupted cut line, aligned slits, a line of scores and any combination of the aforesaid options.

As used herein, the term "severance line" and "weakened line of severance" each refers to all manner of lines formed in a substrate of sheet material, that facilitate separating portions of the substrate from one another, or otherwise indicate optimal separation locations on the substrate. For example, a severance line in a substrate of sheet material is predisposed to allow a tear to propagate there along. A severance line and a weakened line of severance each may be one of the following: a single cut, a single half-cut, a single slit, an interrupted cut, a score line, an interrupted score line, a line of perforations, a line of short cuts, a line of short slits, a line of short half cuts, and any combination of the aforementioned options.

It should be understood that hinged connection, severance lines, weakened lines of severance and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

As used herein the term "cutaway" refers to all manner of shapings, recesses, apertures, cuts, slots, holes and gaps which may be circular, rectangular, capsule shaped, irregular shaped and many other shapes that are pre-formed or pre-defined.

The invention claimed is:

1. A carton for packaging one or more articles comprising:

a top panel having a first side edge and a second side edge, the distance between the first and second side edges defining a lateral size of the top panel;

a base panel having a lateral size generally equal to the lateral size of the top panel;

a first side panel having a first end edge and being disposed along the first side edge of the top panel;

a first side end closure panel hinged to the first end edge of the first side panel by a first hinged connection; and a first cutaway positioned such that a portion of the first side panel adjacent to the first end edge is separated from the top panel;

wherein the first side end closure panel comprises an end edge opposing the first hinged connection, the first hinged connection and the end edge of the first side end closure panel being disposed divergently toward a lower edge of the first side end closure panel when the carton is in a flat blank form, the end edge of the first side end closure panel being disposed substantially perpendicular to the base panel when the carton is in an erected form.

2. The carton according to claim 1 wherein the first side end closure panel comprises an upper edge disposed at an obtuse angle with respect to the hinged connection when the carton is in the flat blank form, the upper edge being disposed substantially parallel to the base panel when the carton is in the erected form.

3. The carton according to claim 1, further comprising:

a second side panel having a first end edge and being disposed along the second side edge of the top panel;

a second side end closure panel hinged to the first end edge of the second side panel by a second hinged connection;

a second cutaway positioned such that a portion of the second side panel adjacent to the first end edge is separated from the top panel;

wherein the second side end closure panel comprises an end edge opposing the second hinged connection, the second hinged connection and the end edge of the second side end closure panel being disposed divergently toward a lower edge of the second side end closure panel when the carton is in the flat blank form and the end edge of the second side end closure panel being disposed substantially perpendicular to the base panel when the carton is in the erected form.

4. The carton according to claim 3 wherein the first side end closure panel and the second side end closure panel are arranged in a partially overlapping relationship to define a seem, wherein the seam is substantially configured to be substantially perpendicular to the base panel.

5. The carton according to claim 4 wherein the second side end closure panel comprises an upper edge arranged at an obtuse angle with respect to the second hinged connection when the carton is in the flat blank form, and the upper edge of the second side end closure panel being disposed substantially parallel to the base panel when the carton is in the erected form.

6. The carton according to claim 5 wherein the upper edge of the first side end closure panel and the upper edge of the second side end closure panel are substantially collinear.

7. A blank for forming a carton, the blank comprising:

a top panel having a first side edge and a second side edge, the distance between the first and second side edges defining a lateral size of the top panel;

a base panel having a lateral size generally equal to the lateral size of the top pap panel;

a first side panel having a first end edge and connected to the first side edge of the top panel along a first hinged connection;

a first side end closure panel hinged to the first end edge of the first side panel by a second hinged connection;

a first cutaway positioned such that a portion of the first side panel adjacent to the first end edge is separated from the top panel;

wherein the first side end closure panel comprises an end edge opposing the second hinged connection, the first hinged connection and the end edge being arranged divergently toward a lower edge of the first side end closure panel, and the end edge being disposed substantially perpendicular to the base panel when the blank is erected into a carton.

8. The blank according to claim 7 wherein the first side end closure panel comprises an upper edge arranged at an acute angle with respect to the first hinged connection, the upper edge being disposed substantially parallel to the base panel when the blank is erected into a carton.

9. The blank according to claim 7, further comprising:

a second side panel having a first end edge;

a second side end closure panel hinged to the first end edge of the second side panel by a third hinged connection;

a second cutaway positioned such that a portion of the second side panel adjacent to the first end edge of the second side panel is separated from the top panel when the blank is erected into a carton;

wherein the second side end closure panel comprises an end edge opposing the third hinged connection, the end edge of the second end closure panel being disposed at either an acute or obtuse angle with respect to said first hinged connection, the end edge of the second side end closure panel being disposed substantially perpendicular to the base panel when the blank is erected into a carton.

10. A blank according to claim 7 further comprising:

a second side panel having a first end edge and being disposed along the second side edge of the top panel;

a second side end closure panel hinged to the first end edge of the second side panel by a third hinged connection;

a second cutaway separating a portion of the top panel from an adjacent portion of the second side panel;

wherein the second side end closure panel comprises an end edge opposing the third hinged connection, the end edge being disposed at either an acute or obtuse angle with respect to said first hinged connection and configured to be substantially perpendicular to the base panel in an assembled carton.

11. A carton for packaging one or more articles comprising:

a top panel having a first side edge and a second side edge;

a base panel;

a first side panel having a first end edge and connected to the first side edge of the top panel along a first hinged connection, the first side panel being longer in length than the top panel; and a first side end closure panel hinged to the first end edge of the first side panel by a second hinged connection;

wherein the first side end closure panel comprises an end edge opposing the second hinged connection, the end edge being arranged at an obtuse angle with respect to the first hinged connection in a flat blank and configured to be substantially perpendicular to the base panel in the assembled carton.

12. A carton according to claim 11 wherein the first side end closure panel comprises a side edge adjacent to the second hinged connection, the side edge being disposed at an acute angle with respect to the first hinged connection in a flat blank and configured to be substantially parallel to the base panel in the assembled carton.

13. A carton according to claim 12 wherein an obtuse angle is defined between the side edge and the second hinged connection when the first side end closure panel is in an unfolded condition.

14. A blank for forming a carton, the blank comprising:

a top panel having a first side edge and a second side edge;

a base panel;

a first side panel having a first end edge and connected to the first side edge of the top panel by a first hinged connection, the first side panel being longer in length than the top panel; and a first side end closure panel hinged to the first end edge of the first side panel by a second hinged connection;

wherein the first side end closure panel comprises an end edge opposing the second hinged connection, the end edge being disposed at an obtuse angle with respect to the first hinged connection and configured to be substantially perpendicular to the base panel in an assembled carton.

15. A blank according to claim 13 wherein the first side end closure panel comprises a side edge adjacent to the second hinged connection, the side edge being disposed at an acute angle with respect to the first hinged connection in a flat blank and configured to be substantially parallel to the base panel in the assembled carton.

16. A blank according to claim 15 wherein an obtuse angle is defined between the side edge and the second hinged connection when the first side end closure panel is in an unfolded condition.

* * * * *